United States Patent [19]

Murray et al.

[11] Patent Number: 4,513,641

[45] Date of Patent: Apr. 30, 1985

[54] CLIMBING AID RETRIEVER

[76] Inventors: Joseph Murray; Jesse Guthrie, both of 2791 Knollsville Land, Vienna, Va. 22180

[21] Appl. No.: 498,510

[22] Filed: May 27, 1983

[51] Int. Cl.[3] ..... B25B 31/00

[52] U.S. Cl. ..... 81/486; 29/278

[58] Field of Search ..... 81/3 R; 29/278, 280, 29/764; 684/227; 269/48.1; 128/92 EC

[56] References Cited

U.S. PATENT DOCUMENTS

| | | | |
|---|---|---|---|
| 2,713,278 | 7/1955 | Stump | 81/3 R |
| 2,853,772 | 9/1958 | Yuter | 29/278 |
| 4,033,032 | 7/1977 | Romania et al. | 29/278 |
| 4,184,657 | 1/1980 | Jardine | 248/1 |
| 4,193,243 | 3/1980 | Tiner | 81/3 R |

OTHER PUBLICATIONS

REI Catalog, 1/84, p. 45.

*Primary Examiner*—James L. Jones, Jr.
*Attorney, Agent, or Firm*—Wells & Wells

[57] ABSTRACT

A retriever for a climbing aid used as an anchor in cracks where the aid has an operating bar. The retriever has:

(a) a fork body with tines;
(b) hooks on the ends of the tines for engaging the operating bar of the climbing aid;
(c) finger holds located on the fork body;
(d) a longitudinal bore in the fork body extending from the base of the tines to the upper end of the fork body;
(e) a rod having a first and a second end and mounted for reciprocation in the bore;
(f) a stop secured to the first end for applying pressure upon the support bar of the climbing aid; and
(g) a handle secured to the second end and engaging the base of a thumb of a climber.

11 Claims, 3 Drawing Figures

CLIMBING AID RETRIEVER

BACKGROUND OF THE INVENTION

The field of the invention is miscellaneous supports and the present invention is particularly concerned with retrieving a climbing aid.

The state of the art of climbing aids may be ascertained by reference to U.S. Pat. No. 4,184,657, the disclosure of which is incorporated herein by reference.

In the sport of mountain climbing it is common practice to secure the climbers together by a rope and to anchor the rope on the face of rock walls being climbed. It is known to use natural anchors such as rock spikes, flakes, and chockstones jammed in rocks. Artificial anchors such as bolts and pitons are also known to be used as firm anchors for climbing ropes.

The climbing aid of U.S. Pat. No. 4,184,657, was introduced as an artificial anchor for use in smooth sided and parallel sided cracks where it is difficult to use chockstones, bolts and pitons.

One problem experienced with the use of the climbing aid of U.S. Pat. No. 4,184,657 is that it becomes lodged in a smooth sided crack and cannot be retrieved. This results in the loss of a valuable climbing aid.

SUMMARY OF THE INVENTION

Having in mind the limitations of the prior art it is the object of the present invention to provide means for retrieving the climbing aid of U.S. Pat. No. 4,184,657 when it is lodged in a crack.

Another object of the present invention is to provide an extension so that the climbing aid of U.S. Pat. No. 4,184,657 can be more conveniently positioned in a crack for securing a climbing rope at the optimum angle.

These objects are achieved by the climbing aid retriever of the present invention having:

(a) a fork body with two tines;

(b) hooks on the end of the tines adapted to engage the operating bar of a climbing aid;

(c) a bar located on the fork body and perpendicular thereto adapted for engaging the fingers of a climber;

(d) a longitudinal bore in the fork body extending from the base of the tines to the upper end of the fork body;

(e) a rod having a length longer than the bore and located for reciprocation in the bore;

(f) a stop secured to the lower end of the rod and adapted to press upon the support bar of a climbing aid; and (g) a handle secured to the upper end of the bar and adapted to engage the base of the thumb of a climber.

Further modifications and preferred embodiments of the climbing aid retriever of the present invention include attachment points for a rope in the handle, a coil spring encompassing the rod and located between the top of the fork body and the handle, a threaded hole in the fork body extending into the bore and an adjustment screw in the threaded hole for securing the rod in a fixed position.

BRIEF DESCRIPTION OF THE DRAWINGS

In order to better describe the invention, drawings are appended hereto showing an embodiment of the climbing aid retriever of the present invention wherein.

DESCRIPTION OF THE PREFERRED EMBODIMENTS

Figure 1:
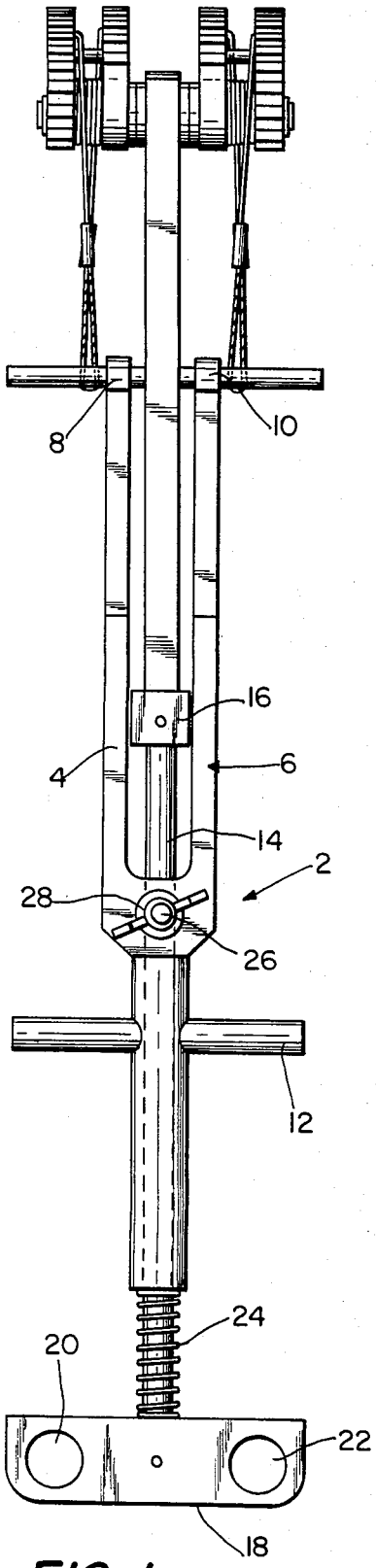
FIG. 1 is a front elevation view of the climbing aid retriever of the present invention in engagement with the climbing aid shown in FIG. 2 of U.S. Pat. No. 4,184,657.
Figure 2:
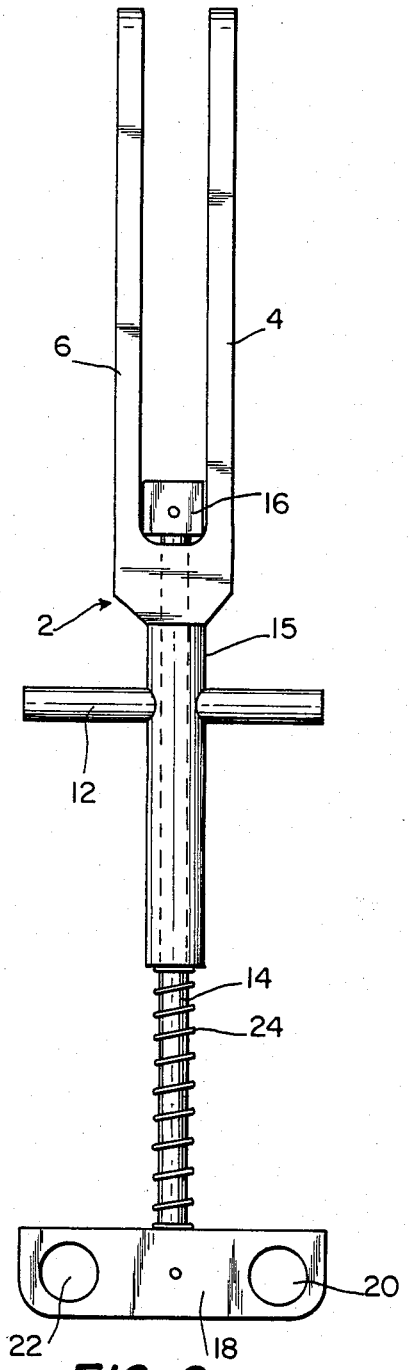
FIG. 2 is a back elevation view of the climbing aid retriever shown in FIG. 1.

With particular reference to FIG. 1, there is shown the climbing aid retriever of the present invention in engagement with the climbing aid shown in FIG. 2 of U.S. Pat. No. 4,184,657, where the fork body 2 has tines 4 and 6, hooks or grapples 8 and 10, a bar 12, a rod 14, a stop 16, a handle 18, attachment points 20 and 22 for a rope, a coil spring 24 for biasing the handle in an extended position, a threaded hole 26 and an adjusting screw 28 for securing the rod in a fixed position.

The rear view showing of FIG. 2 has the bore 15 shown in dotted lines.

Figure 3:
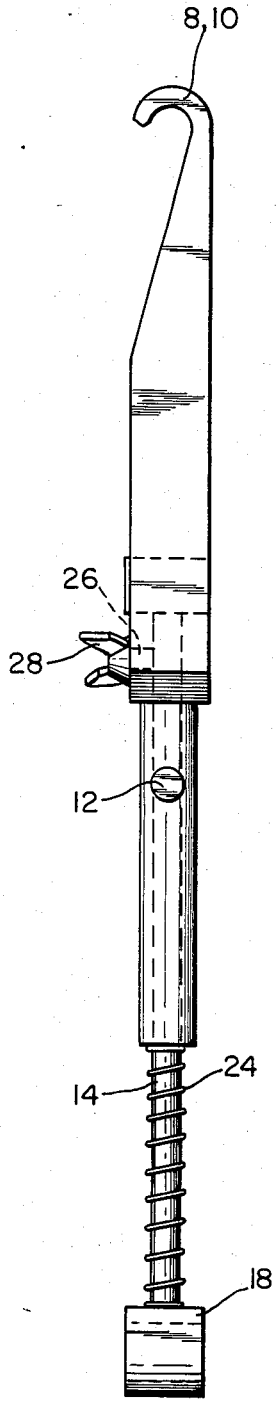
FIG. 3 is a side elevation view of the climbing aid retriever of FIG. 1.

Side view FIG. 3 shows the hooks or grapples 8 and 10 more clearly along with threaded hole 26 in dotted lines and wing nut adjusting screw 28.

BEST MODE OF CARRYING OUT THE INVENTION

A need for the present invention presents itself when the climbing aid of U.S. Pat. No. 4,184,657, is inserted so far into a crack having substantially parallel sides that it is impossible to grasp the operating bar in order to retract the cams so that the climber aid can be removed from the crack.

When this situation presents itself the retriever of the present invention is grasped by one hand of the climber with fingers on the bar 12 and the base of the thumb on the handle 18. The fork is placed in the crack with the hooks or grapples 8 and 10 engaging the operating bar of the climber aid and the stop 16 pressing upon the end of the support bar.

Pressure is applied by the base of the thumb on the handle 18 and the stop 16 presses the operating bar forward so that the operating bar of the climber aid is retracted, the cams rotate and the grip on the sides of the crack is relaxed.

At this point it is wise to rotate the adjusting screw 28 so that the climber aid is held in a retracted position and the aid and retriever are interconnected.

What we claim is:

1. A climbing aid retriever comprising (a) a fork body with longitudinally extended tines;

(b) hooks on the ends of said extended tines adapted to engage an operating bar of a climbing aid;

(c) means located on said fork body adapted for engagement by fingers of one hand of a climber;

(d) a longitudinal bore in said fork body extending from the base of the tines to the upper end of the fork body, said bore having a given length;

(e) a rod having first and second ends and having a length greater than said given length and mounted for reciprocation in said bore;

(f) a stop secured to said first end, guided in reciprocation by said longitudinally extending tines and adapted to apply pressure upon a support bar of a climbing aid;

(g) a threaded hole in said fork body extending into said bore and an adjustment screw engaged in said threaded hole for operation by said one hand of a climber for fixing said reciprocated stop while said pressure is applied upon said support bar; and (h) a handle secured to said second end and adapted to engage the base of a thumb of a climber.

2. The climbing aid retriever of claim 1, further comprising a coil spring encompassing said rod located between said handle and said fork body and biasing said handle in extended position.

3. The climbing aid retriever of claim 2, further comprising means for attaching ropes in said handle.

4. The climbing aid retriever of claim 3, wherein said means adapted for engaging the fingers of a climber is a bar perpendicular to said fork body.

5. The climbing aid retriever of claim 4, wherein means for attaching ropes are holes in said handle.

6. In a climbing aid having means for retrieving comprising a support bar, a spindle mounted on the support bar, at least two cam members pivotally mounted on the spindle and adapted for opposite pivotal movement from a "closed" position to an "open" position, means to apply a force to each cam member to urge it to its "open" position, an operating bar slidably mounted on the support bar and connected to each cam member and there being at the opposite end of the support bar to the spindle an attachment point for a climbing rope, the improvement comprising said means for retrieving comprising:

(a) a fork body with tines;

(b) hooks on the ends of said tines adapted to engage said operating bar of said climbing aid;

(c) means located on said fork body adapted for engaging the fingers of a climber;

(d) a longitudinal bore in said fork body extending from the base of the tines to the upper end of the fork body, said bore having a given length;

(e) a rod having first and second ends and having a given length greater than said given length and mounted for reciprocation in said bore;

(f) a stop secured to said first end and adapted to apply pressure upon said support bar of said climbing aid; and (g) a handle secured to said second end and adapted to engage the base of a thumb of a climber.

7. The climbing aid retriever of claim 6, further comprising a coil spring encompassing said rod located between said handle and said fork body and biasing said handle in extended position.

8. The climbing aid retriever of claim 7, further comprising a threaded hole in said fork body extending into said bore and an adjustment screw engaged in said threaded hole.

9. The climbing aid retriever of claim 8, further comprising means for attaching ropes in said handle.

10. The climbing aid retriever of claim 9, wherein said means adapted for engaging the fingers of a climber is a bar perpendicular to said fork body.

11. The climbing aid retriever of claim 10, wherein means for attaching ropes are holes in said handle.

* * * * *